US008085950B2

(12) United States Patent
Suzuki

(10) Patent No.: US 8,085,950 B2
(45) Date of Patent: Dec. 27, 2011

(54) SOUND SIGNAL PROCESSING APPARATUS AND SOUND SIGNAL PROCESSING METHOD

(75) Inventor: Noriaki Suzuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1226 days.

(21) Appl. No.: 11/764,393

(22) Filed: Jun. 18, 2007

(65) Prior Publication Data

US 2008/0013750 A1 Jan. 17, 2008

(30) Foreign Application Priority Data

Jun. 30, 2006 (JP) ..... 2006-182185

(51) Int. Cl.
*H04R 1/40* (2006.01)

(52) U.S. Cl. ..... 381/97; 381/99; 381/345; 181/160

(58) Field of Classification Search ..... 381/97, 381/350, 345, 119, 349, 99, 100, 98, 61, 381/67, 150; 181/160, 157
See application file for complete search history.

(56) References Cited

U.S. PATENT DOCUMENTS 4,741,040 A * 4/1988 Kaizer ..... 381/103
4,953,655 A * 9/1990 Furukawa ..... 181/160
5,181,251 A * 1/1993 Schultheiss et al. ..... 381/96

FOREIGN PATENT DOCUMENTS

JP 63-120586 5/1988

* cited by examiner

*Primary Examiner* — Xu Mei
*Assistant Examiner* — Con P Tran
(74) *Attorney, Agent, or Firm* — Cowan, Liebowitz & Latman, P.C.

(57) ABSTRACT

A sound signal processing apparatus and a sound signal processing method divide an input signal into a low frequency signal output (11) and a high frequency signal output (10), and delay only the high frequency signal output (10), thereby reducing the temporal shift between the high frequency signal and the low frequency signal. Furthermore, correcting the phase of the low frequency signal output (11) in accordance with a change in phase due to the delay of the high frequency signal output (10) allows to prevent variation in frequency characteristics due to interference at the time of addition of the low frequency signal output (11) and the high frequency signal output (10).

10 Claims, 8 Drawing Sheets

FIG. 7 *(PRIOR ART)*
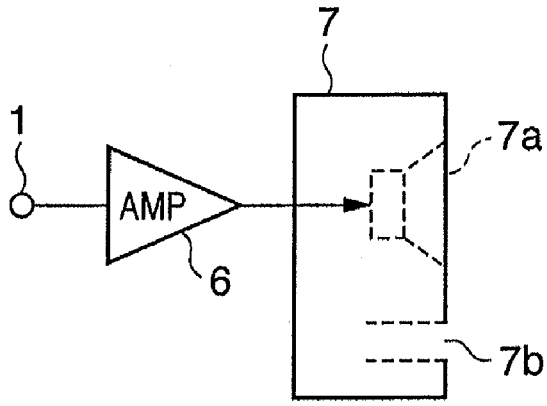

FIG. 8 *(PRIOR ART)*
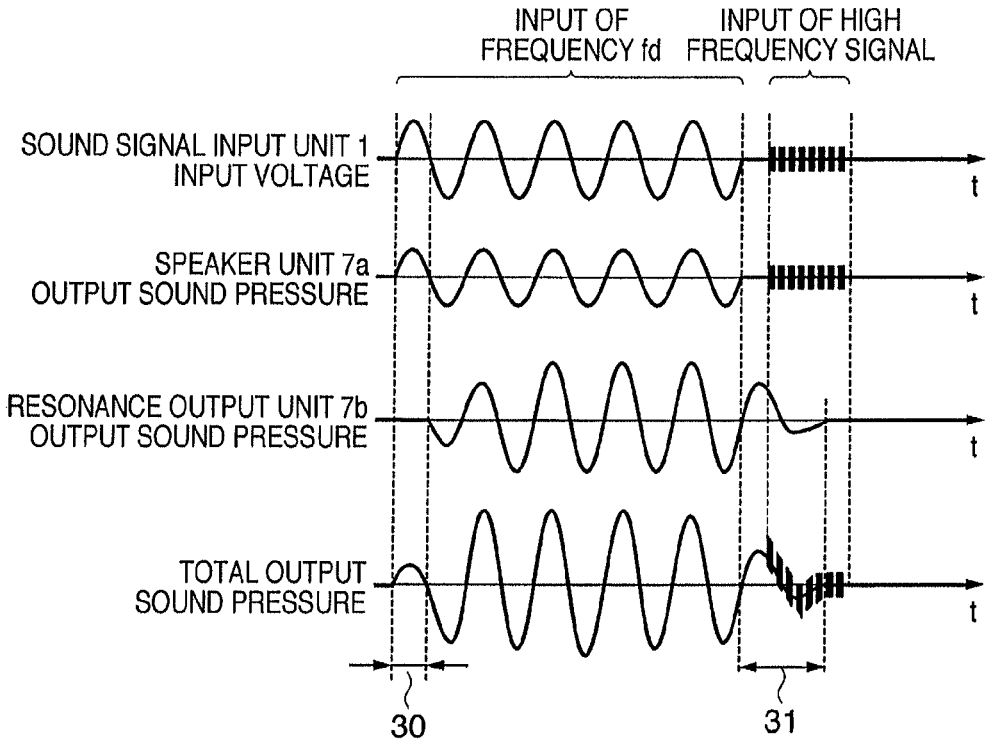

SOUND SIGNAL PROCESSING APPARATUS AND SOUND SIGNAL PROCESSING METHOD

BACKGROUND OF THE INVENTION

1. Field of the Invention

The present invention relates to a sound signal processing apparatus and a sound signal processing method and, more particularly, to a sound signal processing apparatus and sound signal processing method which generate a sound signal output to a phase inversion type speaker.

2. Description of the Related Art

As a technique for improving the bass reproduction characteristics of a speaker, a phase inversion type speaker is known, which comprises a resonance output unit such as bass-reflect ports or a passive radiator.

A sound output from a general phase inversion type speaker will be described below with reference to FIGS. 7 and 8. FIG. 7 is a connection diagram of a phase inversion type speaker 7 and an amplifier 6 which drives it. The phase inversion type speaker 7 shown in FIG. 7 includes a speaker unit 7*a* and a resonance output unit 7*b*. The phase inversion type speaker 7 spatially synthesizes an input voltage from a sound signal input unit 1 with output sound pressures from these units to obtain, as a result, a total output sound pressure.

FIG. 8 shows the schematic waveforms of an input voltage to the sound signal input unit 1, output sound pressures from the speaker unit 7*a* and resonance output unit 7*b* of the phase inversion type speaker 7, and total output pressure obtained by spatially synthesizing them. The phase inversion type speaker 7 increases the sound pressure of the low range by using the phenomenon that resonance is made to occur at a frequency with an emission delay time 30 corresponding to an almost half period by accumulating sound pressure emitted from the back surface of the speaker unit 7*a* in the box internal volume and making the resonance output unit 7*b* emit the sound pressure with a delay.

In the phase inversion type speaker 7, sound emitted from the back surface of the speaker unit 7*a* through the resonance output unit 7*b* with a delay interferes with sound emitted from the front surface of the speaker unit 7*a*. In order to solve this inconvenience, there has been proposed a speaker system which prevents interference with sound emitted from an acoustic tube mounted on the back surface of the speaker by inverting the phase of the sound using bass-reflect ports provided on the front surface of the speaker unit 7*a* (see, for example, Japanese Patent Laid-Open No. 63-120586).

In the phase inversion type speaker 7 described above, however, the emission delay time 30 occurs before the resonance output unit 7*b* emits the sound pressure emitted from the back surface of the speaker unit 7*a* in the bass range.

In addition, even after the speaker unit 7*a* stops vibrating, delayed bass sound is emitted due to the spring action generated by the air in the box internal volume and the equivalent weight action generated by the resonance output unit 7*b* such as a bass-reflect port shape or a passive radiator weight. That is, as shown in FIG. 8, the resonance output unit 7*b* emits the bass sound delayed by a convergence time 31. Therefore, in addition to the problem that sound in the bass range is emitted with a delay with respect to sound in the treble range, if a high frequency signal exists immediately after the stop of vibration, the sound pressure emission times overlap and may cause disturbances such as masking.

SUMMARY OF THE INVENTION

The present invention has been made to solve the above problems, and has its object to provide a sound signal processing apparatus and sound signal processing method which implement the following functions. That is, electrically delaying a high frequency signal input to a phase inversion type speaker allows correction of the temporal shift between a low frequency signal and a high frequency signal due to the structure of the speaker without causing any variation in frequency characteristics.

According to one aspect of the present invention, a sound signal processing apparatus which generates a sound output signal input to a phase inversion type speaker, the apparatus comprises:

a dividing unit which divides an input sound signal into a low frequency signal and a high frequency signal;

a delaying unit which delays a phase of the high frequency signal;

a correcting unit which changes a phase of the low frequency signal in accordance with a frequency of the sound input signal; and a synthesizing unit which generates the sound output signal by synthesizing an output signal from the delaying unit and an output signal from the correcting unit, wherein the correcting unit corrects the phase of the low frequency signal to make the signal become in phase with an output signal from the delaying unit.

According to another aspect of the present invention, a sound signal processing method of generating a sound output signal input to a phase inversion type speaker, the method comprises:

a dividing step of dividing an input sound signal into a low frequency signal and a high frequency signal;

a delaying step of delaying a phase of the high frequency signal;

a correcting step of changing a phase of the low frequency signal in accordance with a frequency of the sound input signal; and a synthesizing step of generating the sound output signal by synthesizing the high frequency signal delayed in the delaying step and the low frequency signal phase-corrected in the correcting step, wherein in the correcting step, the phase of the low frequency signal is corrected to make the signal become in phase with the high frequency signal delayed in the delaying step.

Further features of the present invention will become apparent from the following description of exemplary embodiments (with reference to the attached drawings).

BRIEF DESCRIPTION OF THE DRAWINGS

FIG. 7 is a circuit diagram showing the schematic arrangement of a general phase inversion type speaker; and FIG. 8 is a schematic timing chart showing the waveforms of output sound pressures from the respective units in the general phase inversion type speaker.

DESCRIPTION OF THE EMBODIMENTS

The preferred embodiments of the present invention will be described in detail below with reference to the accompanying drawings. The arrangement exemplified by each embodiment described below is merely an example. The present invention is not limited to the illustrated arrangements.

First Embodiment

Figure 1:
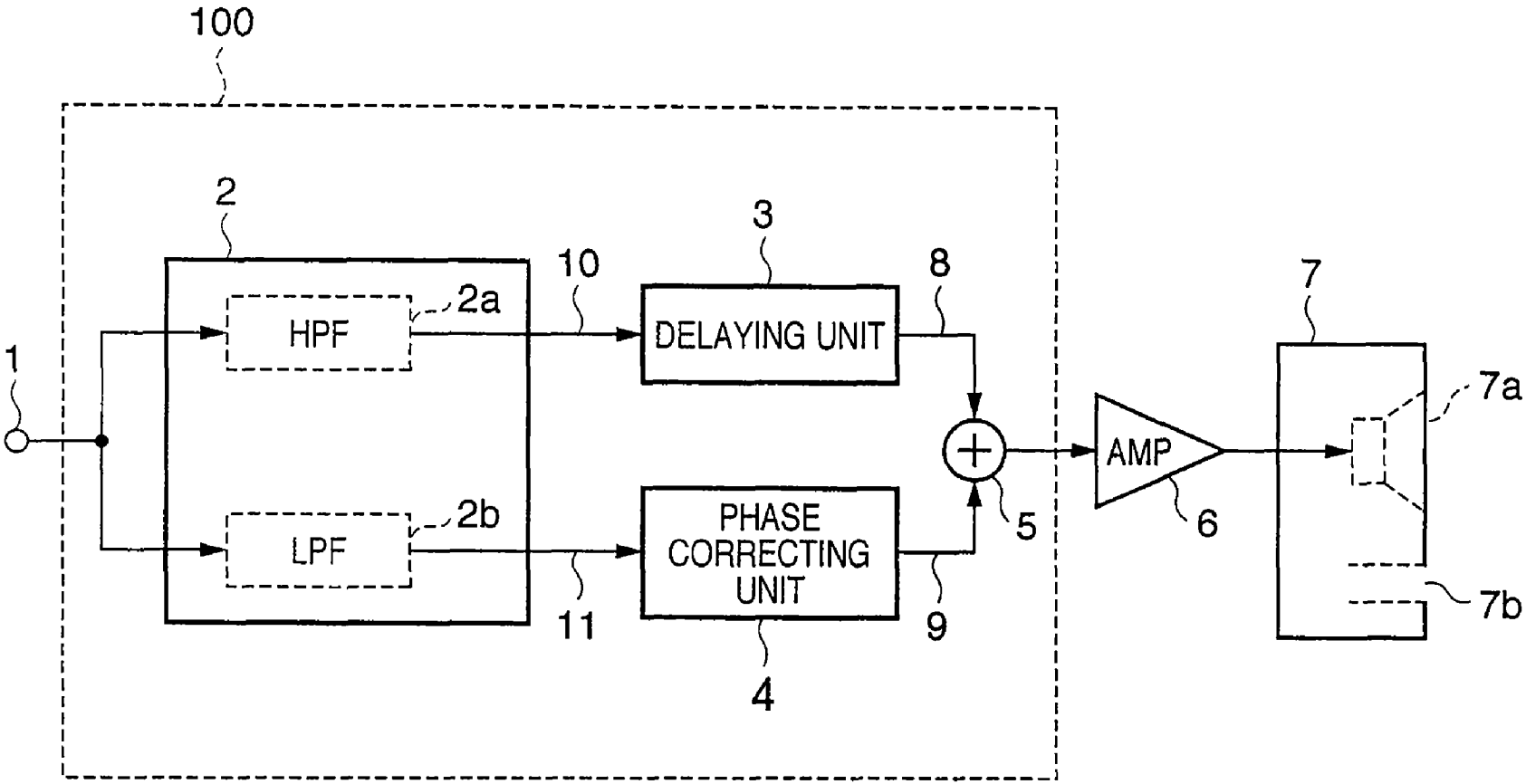
FIG. 1 is a schematic circuit diagram of a sound signal processing apparatus according to an embodiment of the present invention.

FIG. 1 is a schematic circuit diagram of a sound reproducer in the first embodiment. Referring to FIG. 1, reference numeral 100 denotes a sound signal processing apparatus which is a characteristic feature of this embodiment. An amplifier 6 and phase inversion type speaker 7 connecting to the sound signal processing apparatus 100 are identical to those in the prior art shown in FIG. 7. The phase inversion type speaker 7 includes a speaker unit 7*a* and a resonance output unit 7*b* such as bass-reflect ports, a passive radiator, or the like.

The sound signal processing apparatus 100 mainly comprises a band division unit 2, delaying unit 3, phase correcting unit 4, and adding unit 5. The operation of the sound signal processing apparatus 100 will be described in detail below.

A high frequency signal filter 2*a* and low frequency signal filter 2*b* of the band division unit 2 divide the sound signal input to a sound signal input unit 1 into a high frequency signal 10 and a low frequency signal output 11. The cutoff frequencies of the high frequency signal filter 2*a* and low frequency signal filter 2*b* are set to cross over at a frequency 2fd—double a resonance frequency fd of the resonance output unit 7*b* of the connected phase inversion type speaker 7.

Figure 2:
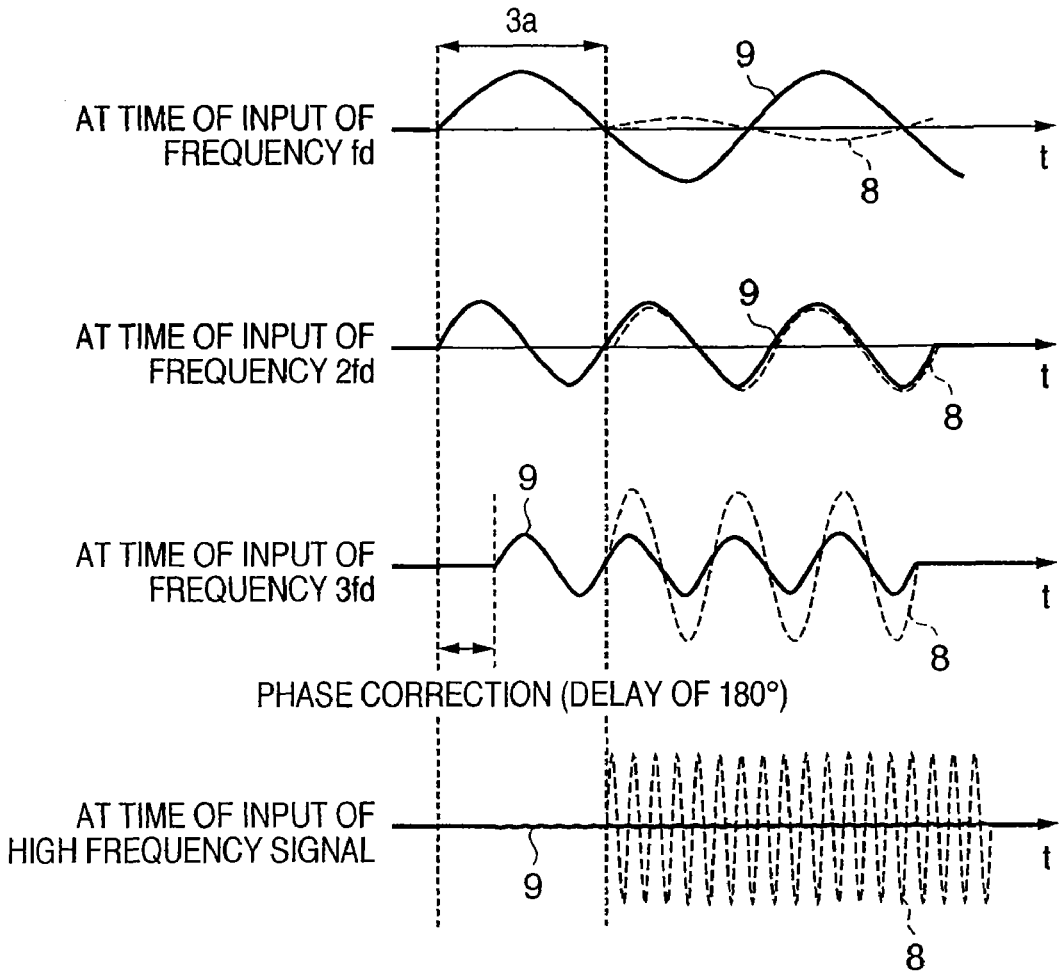
FIG. 2 is a timing chart showing the schematic waveforms of a high frequency signal and low frequency signal divided in this embodiment.

FIG. 2 is a timing chart showing the schematic waveforms of an output signal 8 from the delaying unit 3 and an output signal 9 from the phase correcting unit 4 at the time of input of frequencies fd, 2fd, and 3fd and a high frequency signal from the sound signal input unit 1 in this embodiment. That is, FIG. 2 shows the waveforms (the output signal 8 and output signal 9) of the high frequency signal output 10 and low frequency signal output 11 divided by the band division unit 2 before synthesis.

As is obvious from FIG. 2, at the time of input of any frequency, the delaying unit 3 delays the high frequency signal output 10 divided by the band division unit 2 by a delay time 3*a*, as indicated by the output signal 8. The delay time 3*a* corresponds to an integer multiple of the half period of the resonance frequency fd of the resonance output unit 7*b* of the phase inversion type speaker 7. The following is a case wherein the delay time 3*a* corresponds to the half period of the resonance frequency fd.

At this time, since the crossover frequency in the band division unit 2 is set to 2fd, when the frequency of an input signal is 2fd, the output signal 8 from the delaying unit 3 becomes in phase with the output signal 9 from the phase correcting unit 4. The adding unit 5 adds them to reconstruct a signal having the same amplitude as that of the input signal.

When the frequency of the input signal is equal to the resonance frequency fd, the output signal 8 from the delaying unit 3 is in opposite phase to the output signal 9 from the phase correcting unit 4. However, since the resonance frequency is away from the crossover frequency 2fd by one octave, the characteristics of the high frequency signal filter 2*a* suppress the amplitude of the output signal 9 from the phase correcting unit 4 to an extent that interference at the time of addition by the adding unit 5 poses no serious problem.

If the frequency of an input signal is 3fd which is three times the resonance frequency, the output signal 8 from the delaying unit 3 is in opposite phase to the low frequency signal output 11. In this case, since the frequency falls within one octave from the crossover frequency 2fd, it is difficult for the low frequency signal filter 2*b* to reduce the amplitude. The phase correcting unit 4 therefore performs phase correction with respect to the low frequency signal output 11 to delay the phase by 180° so as prevent interference at the time of addition by the adding unit 5 from posing any problem.

When an input signal is a high frequency signal, since the low frequency signal filter 2*b* suppresses the amplitude of the output signal 9 from the phase correcting unit 4, the signal delayed by the delay time 3*a* is obtained.

In the sound signal processing apparatus 100 of this embodiment, a sound signal controlled in the above manner is output, and the phase inversion type speaker 7 receives the signal through the amplifier 6.

Figure 3:
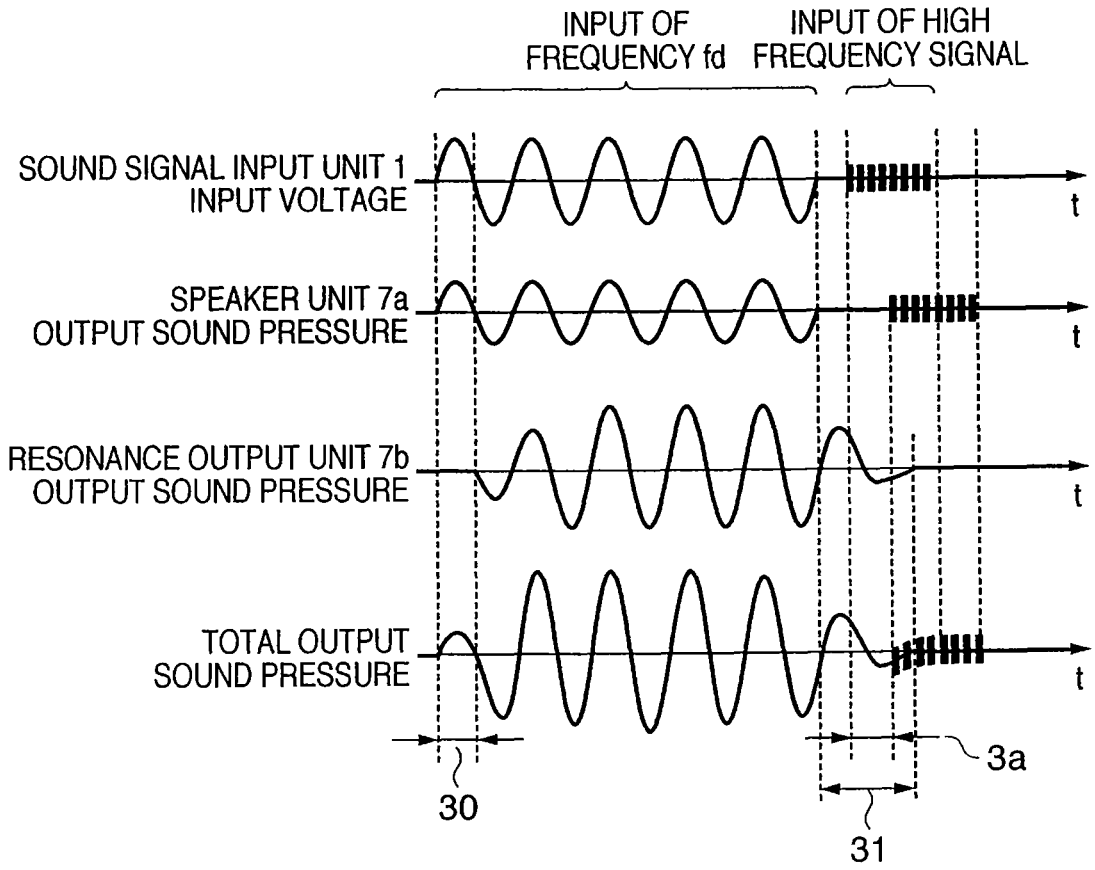
FIG. 3 is a schematic timing chart showing the waveforms of output sound pressures from the respective units in a phase inversion type speaker at the time of input of the signal processed by the sound signal processing apparatus of this embodiment.

FIG. 3 shows the schematic waveforms of an input voltage to the sound signal input unit 1, output sound pressures from the speaker unit 7*a* and resonance output unit 7*b* of the phase inversion type speaker 7, and total output pressure obtained by spatial synthesis of the respective sound pressures. As is obvious from FIG. 3, only a high frequency signal is delayed by the delay time 3*a*. Therefore, a comparison between the schematic timing chart shown in FIG. 3 and that shown in FIG. 8 will reveal that disturbances such as masking which a high frequency signal experiences in a convergence time 31 of the resonance output unit 7*b* are reduced.

As described above, this embodiment divides an input signal into the low frequency signal output 11 and the high frequency signal output 10, and electrically delays only the high frequency signal output 10. At this time, correcting the phase of the low frequency signal output 11 in accordance with a phase change due to the delay of the high frequency signal output 10 prevents the frequency characteristics from varying due to interference at the time of addition of the low frequency signal output 11 and the high frequency signal output 10.

In this manner, this embodiment corrects the temporal shift between the low frequency signal output 11 and the high frequency signal output 10 due to the structure of the phase inversion type speaker 7 without any variation in frequency characteristics. This makes it possible to faithfully reproduce sound.

Second Embodiment

The second embodiment of the present invention will be described below.

Figure 4:
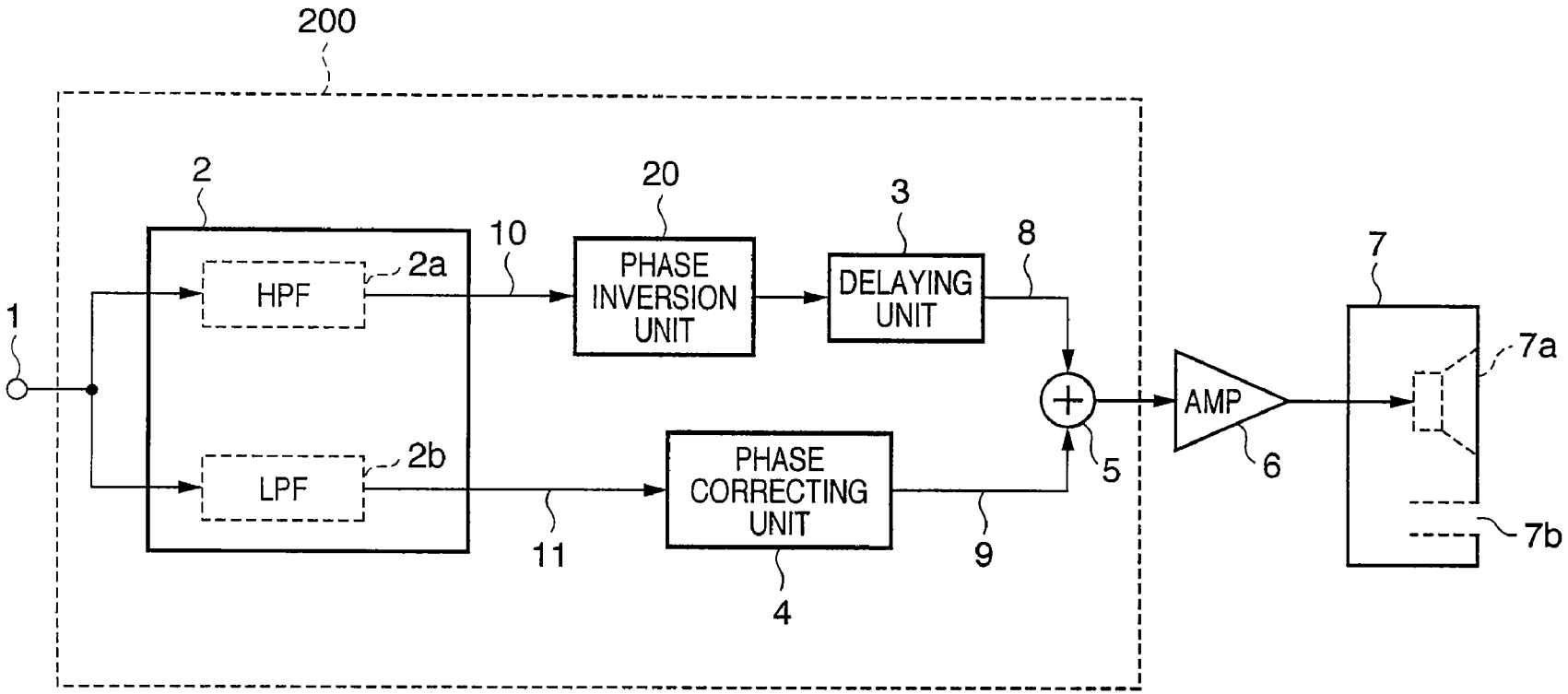
FIG. 4 is a schematic circuit diagram of a sound signal processing apparatus according to the second embodiment.

FIG. 4 is a schematic circuit diagram of a sound reproducer equipped with a sound signal processing apparatus 200 according to the second embodiment. An amplifier 6 and phase inversion type speaker 7 connecting to the sound signal processing apparatus 200 are identical to those in the prior art shown in FIG. 7. The phase inversion type speaker 7 includes a speaker unit 7*a* and a resonance output unit 7*b*.

The same reference numerals as those of the components of the sound signal processing apparatus 200 denote the same as in the first embodiment, and a repetitive description will be omitted. The arrangement of the sound signal processing apparatus 200 is characterized by including a phase inversion unit 20 with respect to a high frequency signal. The operation of the sound signal processing apparatus 200 will be described below.

The phase inversion unit 20 inverts the phase of a high frequency signal output 10 divided by a band division unit 2. A delaying unit 3 then delays the resultant signal by a delay time 3*a*. The delay time 3*a* corresponds to the half period of a resonance frequency fd of the resonance output unit 7*b* of the phase inversion type speaker 7. Note that this apparatus includes the phase inversion unit 20 to invert the phase of a high frequency signal viewed from a low frequency signal. In practice, however, it suffices to invert the phase of either a low frequency signal or a high frequency signal.

Figure 5:
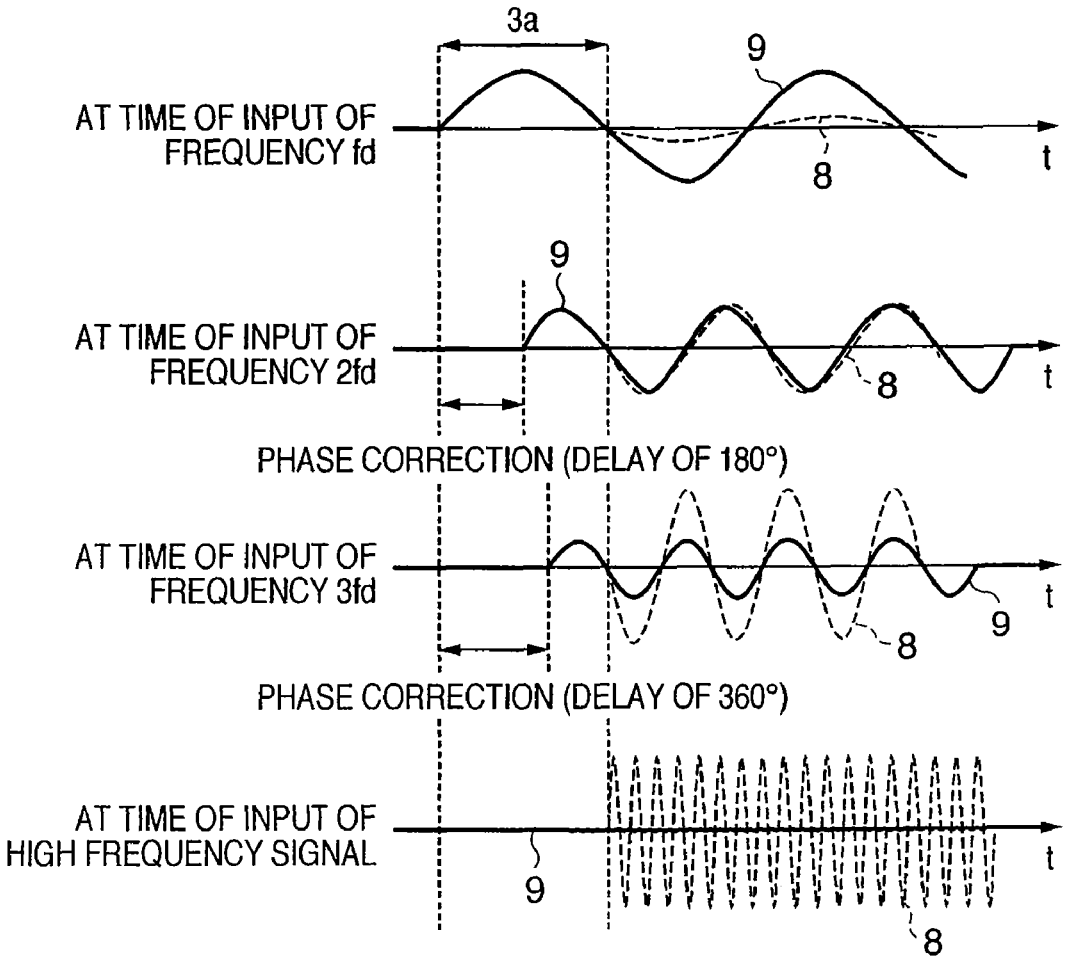
FIG. 5 is a schematic timing chart showing the waveforms of a high frequency signal and low frequency signal divided in the second embodiment.

FIG. 5 is a timing chart showing the schematic waveforms of an output signal 8 from the delaying unit 3 and an output signal 9 from the phase correcting unit 4 at the time of input of frequencies fd, 2fd, and 3fd from the sound signal input unit 1 and at the time of input of a high frequency signal in the second embodiment. That is, FIG. 5 shows the waveforms of the high frequency signal output 10 and low frequency signal output 11 (the output signals 8 and 9) divided by the band division unit 2 immediately before synthesis.

Referring to FIG. 5, the phase of the output signal 9 from the phase correcting unit 4 is corrected to be delayed by 180° and 360° when the input signal frequency is 2fd and 3fd, respectively, thereby making the output signal 9 become in phase with the output signal 8 from the delaying unit 3. In this case, therefore, the adding unit 5 adds the output signal 8 and the output signal 9 without causing any interference to reconstruct a signal having the same amplitude as that of the input signal.

In addition, referring to FIG. 5, since the phase inversion unit 20 inverts the phase of the high frequency signal output 10, the output signal 8 from the delaying unit 3 is in phase with the output signal 9 from the phase correcting unit 4 even if the input signal frequency is fd. At this time, even if the amplitude of the output signal 8 from the delaying unit 3 slightly increases due to variations in the characteristics of a high frequency signal filter 2*a*, the adding unit 5 adds the output signal 8 and the output signal 9 from the phase correcting unit 4 without causing any interference because these two signals are in phase with each other.

If an input signal is a high frequency signal, since a low frequency signal filter 2*b* suppresses the amplitude of the output signal 9 from the phase correcting unit 4, a signal delayed by the delay time 3*a* can be obtained.

In the sound signal processing apparatus 200 of the second embodiment, a sound signal controlled in the above manner is output, and the phase inversion type speaker 7 receives the signal through the amplifier 6. This makes it possible to obtain the waveform of the output pressure shown in FIG. 3 as in the first embodiment. Delaying only the high frequency signal by the delay time 3*a* makes it possible to reduce disturbances such as masking which the high frequency signal experiences in a convergence time 31 of the resonance output unit 7*b*.

As described above, the arrangement of the sound signal processing apparatus 200 exemplified by the second embodiment can also obtain the same effects as those of the first embodiment described above.

Third Embodiment

The third embodiment of the present invention will be described below.

Figure 6:
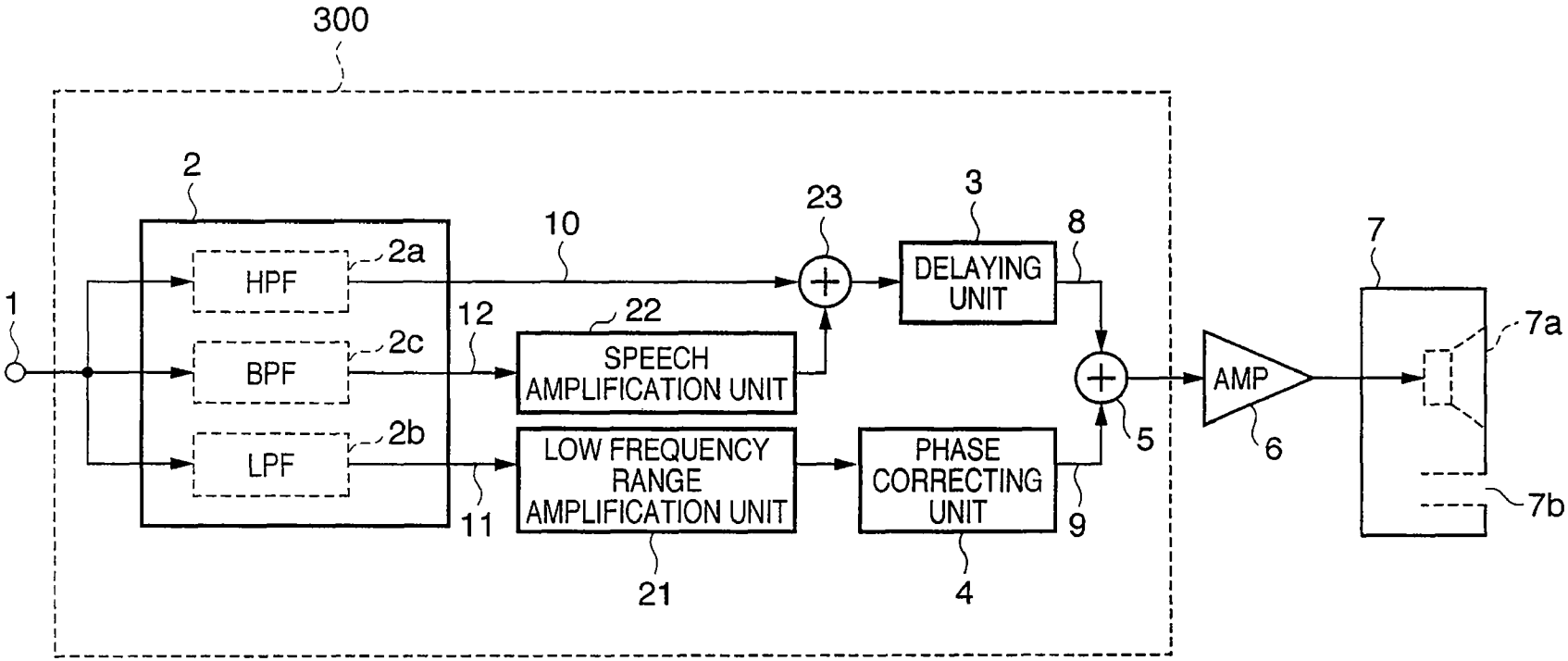
FIG. 6 is a schematic circuit diagram of a sound signal processing apparatus according to the third embodiment.

FIG. 6 is a schematic circuit diagram of a sound reproducer equipped with a sound signal processing apparatus 300 according to the third embodiment. An amplifier 6 and phase inversion type speaker 7 connecting to the sound signal processing apparatus 300 are identical to those in the prior art shown in FIG. 7. The phase inversion type speaker 7 includes a speaker unit 7*a* and a resonance output unit 7*b*.

The same reference numerals as those of the components of the sound signal processing apparatus 300 denote the same as in the first embodiment, and a repetitive description will be omitted. In the sound signal processing apparatus 300 of the third embodiment, a band division unit 2 comprises a midrange frequency signal filter 2*c* in addition to a high frequency signal filter 2*a* and a low frequency signal filter 2*b* to obtain a midrange frequency signal output 12 as well as a high frequency signal output 10 and a low frequency signal output 11. Note that the cutoff frequencies of the midrange frequency signal filter 2*c* and low frequency signal filter 2*b* are set to cross over at a frequency double a resonance frequency fd of the resonance output unit 7*b* of the connected phase inversion type speaker 7.

A speech amplification unit 22 amplifies the human voice component included in the band of the midrange frequency signal output 12 divided by the band division unit 2. A second adding unit 23 adds the resultant output to the high frequency signal output 10, and the delaying unit 3 delays the resultant output by a delay time 3*a*. The delay time 3*a* corresponds to the half period of the resonance frequency fd of the resonance output unit 7*b* of the phase inversion type speaker 7 as in the first embodiment described above.

A low frequency range amplification unit 21 amplifies the low frequency signal output 11 divided by the band division unit 2. This corrects the unbalance due to the amplification of only the midrange frequency signal output 12. After the amplification of the low frequency range, the phase correcting unit 4 performs phase correction to suppress interference in the adding unit 5 as in the first embodiment.

When, for example, the input signal frequency is 3fd which is three times the resonance frequency, the phase correcting unit 4 performs phase correction before addition to prevent interface from posing any problem when an adding unit 5 adds an output signal 8 from a delaying unit 3 and an output signal 9 from a phase correcting unit 4.

When the input signal frequency is 2fd which is double the resonance frequency, the output signal 8 from the delaying unit 3 is in phase with the output signal 9 from the phase correcting unit 4, and hence the adding unit 5 adds them without any interference.

When the input signal frequency is equal to a resonance frequency fd, the characteristics of the midrange frequency signal filter 2*c* suppress the amplitude of the output signal 9 from the phase correcting unit 4, and the adding unit 5 adds the signals without any interference.

When the input signal is a high frequency signal, since the low frequency signal filter 2*b* suppresses the amplitude of the output signal 9 from the phase correcting unit 4, a signal delayed by the delay time 3*a* is obtained.

The sound signal processing apparatus 300 of the third embodiment obtains the waveform of the output sound pressure shown in FIG. 3 with the above control as in the first embodiment. That is, this apparatus reduces disturbances such as masking which a high frequency signal receives in a convergence time 31 of the resonance output unit 7*b*.

As described above, third embodiment can obtain the same effects as those of the first embodiment described above while amplifying a midrange frequency signal, of an input sound signal, which contains a human voice component.

Other Embodiment

Although embodiments have been described in detail above, the present invention can take embodiments as a system, apparatus, method, program, and the like. More specifically, the present invention may be applied to a system constituted by a plurality of devices (e.g., a host computer, interface device, image sensing device, web application, and the like) or an apparatus comprising a single device.

The present invention incorporates a case wherein programs of software for implementing the functions of the embodiments described above are directly or remotely supplied to a system or apparatus to cause the computer of the system or apparatus to read out and execute the programs, thereby implementing the functions. Note that the programs in this case are programs corresponding to the flowcharts shown in the accompanying drawings in the embodiments.

The program codes themselves which are installed in the computer to allow the computer to implement the functions/processing of the present invention also implement the present invention. That is, the computer programs themselves, which implement the functions/processing of the present invention, are also incorporated in the present invention.

In this case, each program may take any form, e.g., an object code, a program executed by an interpreter, and script data supplied to an OS, as long as it has the function of the program.

As a recording medium for supplying the programs, a floppy (registered trademark) disk, hard disk, optical disk, magnetooptical disk, MO, CD-ROM, CD-R, CD-RW, magnetic tape, nonvolatile memory card, ROM, DVD (DVD-ROM or DVD-R), or the like can be used.

In addition, methods of supplying the programs include the following. A client computer connects to a homepage on the Internet by using a browser to download each computer program of the present invention itself from the homepage (or download a compressed file containing an automatic install function into a recording medium such as a hard disk). Alternatively, the programs can be supplied by dividing the program codes constituting each program of the present invention into a plurality of files, and downloading the respective files from different homepages. That is, the present invention also incorporates a WWW server which allows a plurality of users to download program files for causing the computer to execute the functions/processing of the present invention.

In addition, the following operation can be performed. The programs of the present invention are encrypted and stored in a storage medium such as a CD-ROM. Such storage media are then distributed to users. A user who satisfies a predetermined condition is allowed to download key information for decryption from, for example, a homepage through the Internet. The user executes the encrypted programs by using the key information to make the computer install the programs.

The functions of the above embodiments are implemented not only when the readout programs are executed by the computer but also when the OS or the like running on the computer performs part or all of actual processing on the basis of the instructions of the programs.

The functions of the above embodiments are also implemented when the programs read out from the recording medium are written in the memory of a function expansion board inserted into the computer or a function expansion unit connecting to the computer, and the CPU of the function expansion board or function expansion unit performs part or all of actual processing on the basis of the instructions of the programs.

According to the sound signal processing apparatus of the present invention, the above arrangement can correct the temporal shift between a low frequency signal and a high frequency signal due to the structure of a phase inversion type speaker without any variation in frequency characteristics by electrically delaying the high frequency signal input to the speaker.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-182185, filed Jun. 30, 2006, which is hereby incorporated by reference herein in its entirety.

What is claimed is:

1. A sound signal processing apparatus which generates a sound output signal input to a phase inversion type speaker, the apparatus comprising:

a dividing unit which divides an input sound signal into a low frequency signal and a high frequency signal;

a delaying unit which delays a phase of the high frequency signal;

a correcting unit which changes a phase of the low frequency signal in accordance with a frequency of the input sound input signal; and a synthesizing unit which generates the sound output signal by synthesizing an output signal from said delaying unit and an output signal from said correcting unit, wherein said correcting unit corrects the phase of the low frequency signal to make the signal become in phase with the output signal from said delaying unit; and wherein the sound output signal generated by the synthesizing unit is used as the input to the phase inversion type speaker.

2. The apparatus according to claim 1, further comprising an inverting unit which inverts the phase of the high frequency signal with respect to the low frequency signal, wherein said correcting unit corrects the phase of the low frequency signal to make the low frequency signal in phase with the high frequency signal inverted by said inverting unit and delayed by said delaying unit.

3. The apparatus according to claim 1, wherein said dividing unit divides an input sound signal into a low frequency signal, a midrange frequency signal, and a high frequency signal, said apparatus further comprising:

an amplifying unit which amplifies the midrange frequency signal; and a second synthesizing unit which synthesizes the midrange frequency signal amplified by said amplifying unit with the high frequency signal, wherein said delaying unit delays a phase of an output signal from said second synthesizing unit.

4. The apparatus according to claim 3, wherein said dividing unit comprises a high frequency signal filter through which high frequency component of the input sound signal passes and the high frequency signal filter outputting the high frequency signal;

a midrange frequency signal filter through which midrange frequency component of the input sound signal passes and the midrange frequency signal filter outputting the midrange frequency signal; and a low frequency signal filter through which low frequency component of the input sound signal passes and the low frequency signal filter outputting the low frequency signal.

5. The apparatus according to claim 1, wherein a delay time in said delaying unit corresponds to an integer multiple of a half period of a resonance frequency of a resonance output unit of the phase inversion type speaker.

6. The apparatus according to claim 1, wherein the resonance output unit of the phase inversion type speaker comprises bass-reflect ports.

7. The apparatus according to claim 1, wherein the resonance output unit of the phase inversion type speaker comprises a passive radiator.

8. The apparatus according to claim 1, wherein said dividing unit comprises a high frequency signal filter through which high frequency component of the input sound signal passes and the high frequency signal filter outputting the high frequency signal; and a low frequency signal filter through which low frequency component of the input sound signal passes and the low frequency signal filter outputting the low frequency signal.

9. A sound signal processing method of generating a sound output signal input to a phase inversion type speaker, the method comprising:

a dividing step of dividing an input sound signal into a low frequency signal and a high frequency signal;

a delaying step of delaying a phase of the high frequency signal;

a correcting step of changing a phase of the low frequency signal in accordance with a frequency of the input sound signal; and a synthesizing step of generating the sound output signal by synthesizing the high frequency signal delayed in the delaying step and the low frequency signal phase-corrected in the correcting step, wherein in the correcting step, the phase of the low frequency signal is corrected to make the signal become in phase with the high frequency signal delayed in the delaying step; and wherein the sound output signal generated in the synthesizing step is used as the input to the phase inversion type speaker.

10. The method according to claim 9, wherein said dividing step comprises a high frequency signal filtering step of making high frequency component of the input sound signal pass through a high frequency signal filter and outputting the high frequency signal; and a low frequency signal filtering step of making low frequency component of the input sound signal pass through a low frequency signal filter and outputting the low frequency signal.

* * * * *